US007235022B2

(12) United States Patent
Pepe

(10) Patent No.: US 7,235,022 B2
(45) Date of Patent: Jun. 26, 2007

(54) GOLF CLUB REST

(76) Inventor: Frank Pepe, 622 Riverwood Ave., Pt. Pleasant, NJ (US) 08742

( * ) Notice: Subject to any disclaimer, the term of this patent is extended or adjusted under 35 U.S.C. 154(b) by 57 days.

(21) Appl. No.: 11/240,879

(22) Filed: Oct. 3, 2005

(65) Prior Publication Data

US 2007/0078024 A1 Apr. 5, 2007

(51) Int. Cl.
*A63B 55/10* (2006.01)

(52) U.S. Cl. ..... 473/282; 248/156

(58) Field of Classification Search ..... 473/282; 211/70.2; 248/156; D21/796; 248/520–530
See application file for complete search history.

(56) References Cited

U.S. PATENT DOCUMENTS 5,467,980 A * 11/1995 Weisenstein ..... 473/282
D400,612 S * 11/1998 Rubin ..... D21/796
6,497,327 B1 * 12/2002 Rindfleisch ..... 211/70.2

* cited by examiner

*Primary Examiner*—Stephen Blau
(74) *Attorney, Agent, or Firm*—Clifford G. Frayne

(57) ABSTRACT

A golf club rest removably securable to the golf bag of a golfer, and utilized to support a plurality of golf clubs in a substantially vertical position when the golfer must venture a distance from the golf cart, the golf club rest comprising a vertical leg portion having a first end for insertion into the ground, the second end being bent into a horizontal plain perpendicular to the vertical leg section and arcuately formed and covered with a resilient grip, an attachment finger secured to said vertical leg proximate said second end, the attachment finger spaced apart from the vertical leg a distance sufficient to allow the upper peripheral edge of a golf bag to be slidably inserted there between, the arcuate upper end of the vertical leg-coextensive with the curvature of the peripheral edge of the golf bag when so positioned thereon.

5 Claims, 1 Drawing Sheet

GOLF CLUB REST

BACKGROUND OF THE INVENTION

1. Field of the Invention

The present invention relates to the sport of golf and in particular, to a portable golf club rest removably securable to the golfer's bag, allowing the golfer to utilize the golf club rest in supporting a plurality of golf clubs when the golfer must venture distantly from the golf cart.

2. Description of the Prior Art

In many instances when playing golf, a golfer will utilize a motorized golf cart to circumnavigate the course. On many courses and in certain climatic conditions, the golf carts are not allowed on the fairways. Many courses adhere to a strict policy of golf cart paths only, which means the golfer must maintain the golf cart on the macadam or concrete path for the entire course of the round. In certain climatic conditions, the fairways are deemed too fragile for the support of golf carts, and the golf cart users are warned to keep the golf carts on the right or left side rough. Still further, when approaching the putting greens, most all courses direct that the golf carts congregate in a particular area adjacent the putting green.

Unfortunately, most golfers are not blessed with the ability to strike their golf shots so that they land in proximity of the golf cart path or the edge of the fairway adjacent the rough where the golf carts are mandated. In those instances, the golfer must walk across the fairway to locate his ball and determine the type of shot that he can hit. Since most golf courses encourage a faster pace of play, the golfer in this situation would normally take two or three clubs with him in anticipation of the shot that he might be able to hit. After choosing the club which he will utilize, he has no choice but to let the other clubs lie on the ground or lean against a tree while he executes the shot. In doing so, the grips become wet from dew during early morning play, and soiled. Still further, if the golfer is executing a shot from deep rough, he may completely forget about the clubs which he has dropped and return to the cart.

The same situation occurs around the putting green where the golf cart parking area is on one side of the green and the golfer's ball is on the other side of the green. The golfer knows that he needs the putter for the putting surface, but does not know whether he needs a sand wedge or a pitching wedge for his approach shot. Therefore, the same condition occurs and the same problems occur around the putting green as well as on the fairway. In the foregoing situations, the golfer is required to bend at the knees or waist to retrieve the clubs from the ground which repetitive motion during the round can be tiresome.

The present invention was developed in order to provide for a portable, light weight golf club rest, which the golfer can easily remove from the golf bag with the clubs he selects when he has to venture a distance from the golf cart in order to determine the type of shot that he has to make and the proper club to use. The golf rest allows the golfer to maintain the extra clubs in an upright position so that the grips do not become wet or soiled. Still further, since they are positioned in an upright position, it is more difficult for the golfer to forget that he has the extra clubs with him when he returns to the cart.

OBJECTS OF THE INVENTION

An object of the present invention is to provide for a novel golf club rest which will support a plurality of golf clubs in a substantially vertical position while the golfer executes a shot with a separate club.

A further object of the present invention is to provide for a novel golf club rest which is light weight and removably securable to the golfer's golf bag.

A still further object of the present invention is to provide for a novel golf club rest which when removably secured to the golfer's golf bag, does not interfere with the golfer's selection of golf clubs or the golfer's access to the various storage areas in the golf bag.

A still further object of the present invention is to provide for a novel golf club rest having a vertical leg which is easily insertable into the ground in order to provide support for a plurality of golf clubs in a substantially vertical position thereby preventing the grips of the golf club from becoming soiled or wet.

SUMMARY OF THE INVENTION

A golf club rest removably securable to the golf bag of a golfer, and utilized to support a plurality of golf clubs in a substantially vertical position when the golfer must venture a distance from the golf cart, the golf club rest comprising a vertical leg portion having a first end for insertion into the ground, the second end being bent into a horizontal plain perpendicular to the vertical leg section and arcuately formed and covered with a resilient grip, an attachment finger secured to said vertical leg proximate said second end, the attachment finger spaced apart from the vertical leg a distance sufficient to allow the upper peripheral edge of a golf bag to be slidably inserted there between, the arcuate upper end of the vertical leg coextensive with the curvature of the peripheral edge of the golf bag when so positioned thereon.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
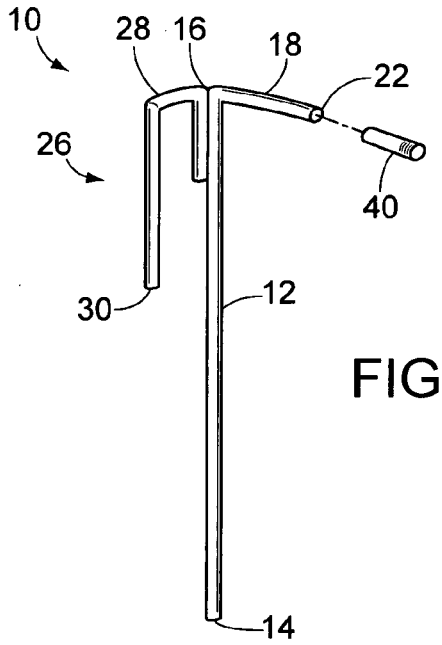
FIG. 1 is a front plan view of the golf club rest of the present invention.
Figure 2:
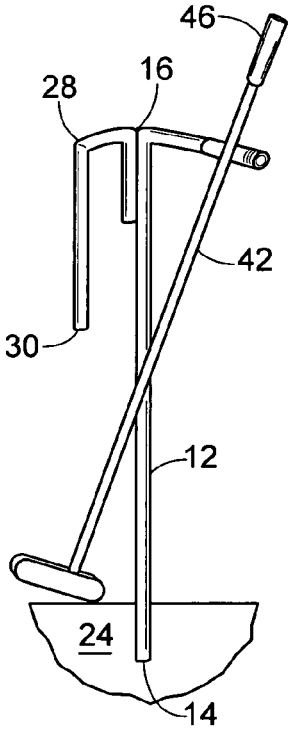
FIG. 2 is a plan view of the golf club rest of the present invention illustrating the support of a plurality of golf clubs.

FIG. 1 is a front plan view of the golf club rest 10 of the present invention, and FIG. 2 is a plan view of the golf club rest inserted in the ground and supporting clubs. Golf club rest 10 is comprised of a vertical leg member 12 having a lower, ground insertion end 14 and an upper end 16 which terminates with a golf rest horizontal arm 18 contiguous with vertical leg 12 and substantially perpendicular thereto, golf rest horizontal arm 18 being slightly arcuate between 20 its juncture with upper end 16 of vertical leg 12 and its extended end 22. Golf rest horizontal arm 18 serves as a handle for the transport of the golf club rest 10 as well as a handle for the forcible insertion of lower end 14 of vertical leg 12 into the ground 24.

Figure 3:
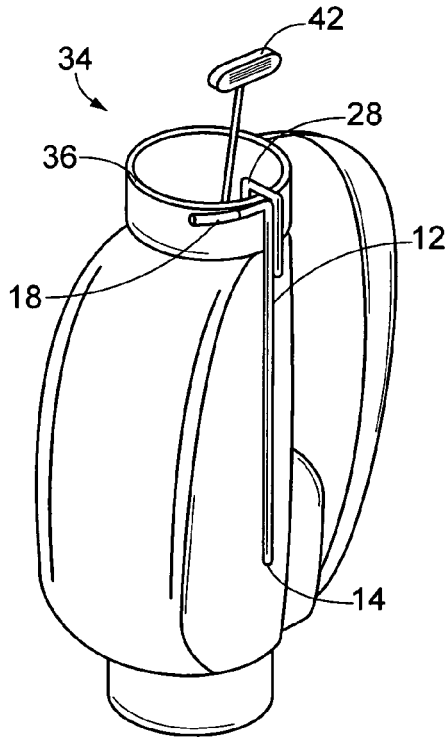
FIG. 3 is a perspective view of the golf club rest of the present invention in its removably secured position with a golf bag.

Attached to vertical leg 12 is an attachment arm 26 illustrated as U-shaped in FIGS. 1 and 2. The short leg 28 of attachment arm 26 is junctured at the top end 16 of vertical leg 12, and the longer leg 30 extends downwardly parallel to vertical leg 12. The distance between vertical leg 12 and the longer leg 30 of attachment arm 26 is of a distance sufficient to allow longer leg 30 of attachment arm 26 to be slidably inserted into the interior cavity 32 of a golf bag 34, allowing vertical leg 12 to hang on the exterior of the golf bag 34. Horizontal arm 18 and the arcuate curvature thereof is designed to conform to the circumferential curvature 36 of the golf bag 34 on its exterior periphery so as to provide for compact storage when not in use and not interfere with a golfer's selection of club from the golf bag (See FIG. 3).

Preferably horizontal arm 18 would be covered or wrapped with a semi-resilient material 40 such as that used for the grips applied to a golf club.

In operation, when the golfer is faced with the prospect of playing a shot which is a substantial distance from the golf cart and the golf cart cannot be driven to the location of the ball, the golfer would remove the golf club rest 10 from the golf bag 34, select those clubs 42 which he feels he may need in order to execute a shot from the balls position, and walk to the golf ball. The golfer would then utilizing horizontal arm 18, force the lower end 14 of vertical end 12 into the ground 24, thus providing an independent golf club rest 10. After examining the lie of the ball, the golfer can select one of the clubs 42 which he has transported and the other clubs 42 can be leaned against the horizontal arm 18 of the golf club rest 10 in a position so as to not interfere with his swing and the shot. The clubs 42 not used are thus positioned in an angularly upright position which protects the grips 46 from any moisture or dew on the ground and from any exposure to soil. Further, the clubs 42 are in an upright position and easily visible by the golfer such that it is unlikely that he will return to the cart with the selected club in his hand and forget to bring the additional clubs which he has transported.

Upon returning to the motorized golf cart, the golfer can place his golf clubs 42 in the cavity 32 of the golf bag 34 and slide the golf club rest 10 over the peripheral edge 36 of the golf bag 34, long leg 30 disposed internally of golf bag 34 and vertical leg 12 downwardly on the exterior of the golf bag with arcuate horizontal arm 18 conforming to the arcuate periphery of the golf bag 34, thereby positioning it for further use and such that it will not interfere with his subsequent selection of a golf club from the golf bag.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A golf club rest for supporting the grip portion of a plurality of golf clubs whose head portions rest on the ground, comprising:

a portable frame comprising a vertical leg member having a lower end adapted to be inserted into the ground and an upper end spaced from the ground at a height engageable with said grip portion of said plurality of golf clubs whose said head portions rest on the ground, said upper end having an arcuate bend forming an arcuate support arm perpendicular with said vertical leg portion, said arcuate support arm for support of said grip portion of said golf clubs;

an attachment arm secured to said upper end of said vertical leg member, said attachment arm having a horizontal attachment member perpendicular to said vertical leg member and a depending attachment member parallel to said vertical leg member, the distance between said vertical leg member and said depending attachment member sufficient to accommodate the peripheral edge of an open end of a golf bag to permit said golf club rest to be removably hung there from wherein the arcuate bend of said support arm conforms to a circumferential periphery of said golf bag when said depending attachment member is hung on said peripheral edge of said open end of said golf bag.

2. The golf club rest in accordance with claim 1 wherein said attachment arm is L-shaped.

3. The golf club rest in accordance with claim 1 wherein said attachment arm is U-shaped.

4. The golf club rest in accordance with claim 1 wherein said arcuate support arm is encased with a resilient material.

5. The golf club rest in accordance with claim 1 wherein said arcuate support arm serves as a handle for positioning said lower end of said vertical leg member into said ground.

* * * * *